United States Patent [19]

Haslegrave et al.

[11] Patent Number: 4,673,436

[45] Date of Patent: Jun. 16, 1987

[54] N, S CONTAINING CORROSION INHIBITORS

[75] Inventors: John A. Haslegrave, Abingdon, United Kingdom; Daniel S. Sullivan, Houston, Tex.

[73] Assignee: Exxon Chemical Patents Inc., Linden, N.J.

[21] Appl. No.: 855,020

[22] Filed: Apr. 22, 1986

[51] Int. Cl.[4] ..... C04B 9/02

[52] U.S. Cl. ..... 106/14.13; 106/14.05; 106/14.15; 252/391; 252/394; 252/395; 422/7

[58] Field of Search ..... 106/14.13, 14.15, 14.05; 252/391, 394, 395; 422/7

[56] References Cited

U.S. PATENT DOCUMENTS 4,188,359 2/1980 Quinlan ..... 422/12

*Primary Examiner*—Lorenzo B. Hayes

*Attorney, Agent, or Firm*—R. L. Graham

[57] ABSTRACT

Corrosion inhibition is obtained by treating a system containing corrosion susceptible metal with a corrosion inhibiting amount, preferably 1 to 10,000 ppm of a thio substituted quaternary ammonium salt, preferably of the general structure:

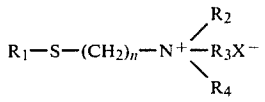

wherein $R_1$ is preferably H or an alkyl group of 8 to 18 carbon atoms, n is 2 or 3, $R_2$, $R_3$ and $R_4$ are preferably alkyl groups of 1 to 18 carbon atoms and two of $R_2$, $R_3$ and $R_4$ are methyl.

20 Claims, No Drawings

N, S CONTAINING CORROSION INHIBITORS

BACKGROUND OF THE INVENTION

1. Field of the Invention

The present invention relates to corrosion inhibitors containing both nitrogen and sulfur, in particular the present invention concerns the method of inhibiting corrosion with thio substituted quaternary ammonium salts.

2. Related Art

Nitrogen containing compounds are known to act as corrosion inhibitors, for example, various amines are effective to inhibit corrosion. A number of patents illustrate corrosion inhibitors containing sulfur and/or nitrogen, e.g., sulfur—U.S. Pat. Nos. 3,809,655, 3,759,956, 3,755,176, 3,158,476, 2,880,180, 3,404,094, 3,197,403, 3,969,414; nitrogen—U.S. Pat. Nos. 3,445,441, 3,450,646, 3,976,593; sulfur and nitrogen—3,414,521, 4,450,138.

U.S. Pat. No. 4,450,138 for example, discloses among other reactions, the reaction of thiols with epichlorohydrin followed by the reaction with amines to produce compounds of the general structure:

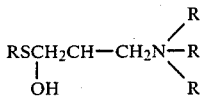

The presence of the hydroxy group would tend to detract from corrosion inhibition based on the analogous compositions prepared by reacting a base amine and alkoxylate which decreases the performance of the quaternary amine compound compared to hydrogen radical being the substituent. U.S. Pat. No. 3,271,443 also discloses alkylamino-2 hydroxypropyl quaternary ammonium compounds including sulfide linkages to form bisquaternary ammonium compounds which are used in halide photographic emulsions as sensitizers.

The synthesis of sulfide compounds of the general formula:

$$R-{}^{+}N(-CH_3)_2CH_2CH_2SH\ Br^-$$

is disclosed by Anoardi, et al, Functional Micellar Catalysis, Synthesis and Properties of Thiocholine - Type Surfactants, Gazzetta Chimica Italiana, 108, 1978, pg. 707–708, Societa Chimica Italiana as does Moss, et al. A Critical Concentration for Micellar Diastereoselectivity, Tetrahedron Letters, Vol. 24, No. 26, pg. 2615–2618, 1983.

However, there is no mention in this prior art of the thio substituted quaternary ammonium salts per se, i.e., those not substituted with other groups such as OH, as having corrosion inhibiting properties.

SUMMARY OF THE INVENTION

Briefly stated, it has now been found that thio substituted quaternary ammonium salts of preferably the general structure:

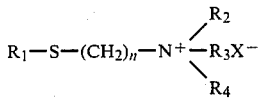

are very effective corrosion inhibitors, wherein $R_1$ is hydrogen or a hydrocarbyl group, preferably an alkyl group, of 6 to 30 carbon atoms, n is 0 to 18, preferably 2 to 6 and $R_2$, $R_3$ and $R_4$ are independently selected from hydrogen alkyl or aralkyl, preferably alkyl groups having 1 to 30 carbon atoms and X is an anion, preferably a halide. The method comprises treating a system where metals are susceptible to corrosion with a corrosion inhibiting amount of the thio substituted quaternary ammonium salts described above. One preferred class of salts according to the present invention are those where $R_1$ is an alkyl radical having 8 to 18 carbon atoms, n is 2 or 3, preferably 3, $R_2$, $R_3$ and $R_4$ are methyl and X is Cl, Br or I and more preferably $R_1$ is an alkyl radical from 8 to 16 carbon atoms and X is I. Another preferred class of salts is that wherein $R_1$ is hydrogen, $R_2$ is an alkyl radical having 6 to 30 carbon atoms, preferably 8 to 18 carbon atoms, n is 3, $R_3$ and $R_4$ are methyl radicals and X is Cl, Br or I, more preferably Br.

Suitable groups for $R_1$ include hydrocarbon or substituted hydrocarbon, for example, alkyl, cycloalkyl, aryl, aralkyl, alkaryl, such as methyl, ethyl, butyl, hexyl, octyl, decyl, dodecyl, phenyl, tolyl and the like. The alkyl group may be straight chain or branched.

Suitable alkyl and aralkyl groups for $R_2$, $R_3$ and $R_4$ may be methyl, ethyl, butyl, hexyl, decyl, dodecyl, octadecyl, benzyl and the like.

Although X is preferably a halogen, other acid counter ion groups are generally acceptable, such as $SO_4^=$, $HSO_4^-$, $HPO_4^=$ and the like.

DETAILED DESCRIPTION OF THE INVENTION

Thio Compound Synthesis

Method 1

One synthesis route to the thio species is shown below in Scheme 1 where Michael addition of the alkyl thiol to acrylamide in the presence of benzyl trimethyl ammonium hydroxide (catalyst) leads to the crystallization of the adducts (13)–(15) in essentially quantitative yield. Reduction of amides by lithium aluminum hydride (LAH) in tetrahydrofuran (THF) solution, produces the desired amines (16)–(18) which are converted to desired halide by reaction of the methyl iodide with the amines.

Scheme 1

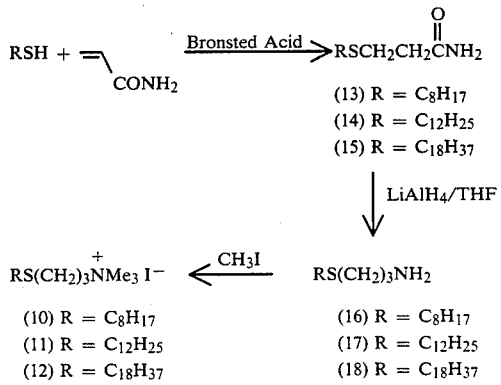

Method 2

This method is based upon dibromoethane and dibromopropane and alkyl thiols. Twenty-five percent NaOMe in methanol solution is added to alkyl thiols ($C_8$, $C_{12}$, $C_{18}$) to generate sodium alkyl sulfides. These salts form the active nucleophiles which are added slowly, in methanol solution to the dibromoalkanes. A mixture of mono- (23)–(28) and diadducts (29)–(34) is obtained in each case, which may be separated by differential solubility. Reaction of the octyl adduct (23) with aqueous trimethyl amine yields the desired trimethyl ammonium bromide (35) shown in scheme 2.

Scheme 2

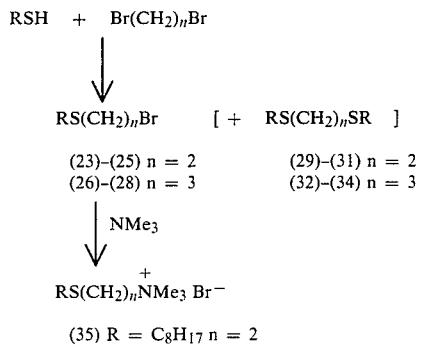

Method 3

The reaction of 2-dimethyl-amino ethanethiol (22) with 2 moles of sodium methoxide to generate the sulfide anion, followed by addition of bromoalkane and stirring at room temperature, yields the desired dimethylamino derivatives (36)–(38). Treatment of these tertiary amines with methyl iodide yields the desired quaternary ammonium iodides (7)–(9) in Scheme 3.

Scheme 3

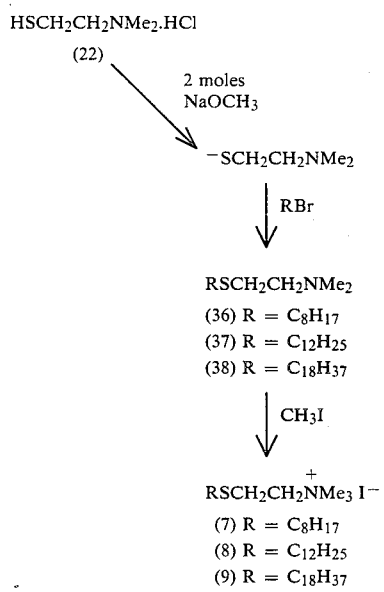

Method 4

An identical route to that of Method 3 was employed for derivatives of 3-dimethylaminopropanethiol (39) in scheme 4. One mole of NaOMe was required to generate sulfide anion as a precursor to the tertiary amines (40)–(42) and methyl iodide conversion to quaternary compounds (10)–(12).

3-Dimethylaminopropanethiol was synthesized from 3-dimethylaminopropanechloride hydrochloride (43). Reaction with thiourea for 24 hours in refluxing 95% ethanol yielded the isothiuronium salt (44). Disappearance of thiourea was monitored by I.R. Ethanol was distilled off and the residue was hydrolyzed over two hours in refluxing NaOH solution. The colorless oil was separated and dried; nmr analysis showed this to be >95% pure amino-thiol (39).

Tertiary amines derived from amino-sulfide anions were obtained in >95% purity by nmr analysis following work up and selective solubility extractions. Quaternary compounds obtained from free amines in refluxing IPA were found to contain up to 20% impurity of the undesirable tertiary amines due to reaction of the thiol group under these experimental conditions. These compounds were not easily separated and were used in corrosion tests as mixtures.

Scheme 4

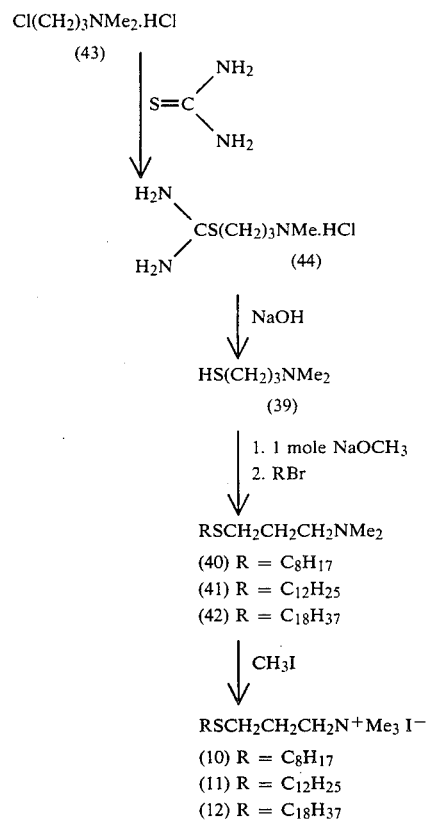

Method 5

A route using 2 di-N-methyl amino ethanethiol (22) was developed in which the reaction of this material with a suitable alkyl halide could be carried out at the nitrogen (by reneutralization of the hydrochloride salt).

The reaction of 2-dimethy amino ethanethiol (22 with 1 bromoalkanes yielded the quaternary ammonium bromides (1)–(3) following reflux in isopropyl alcohol (IPA) solution for 2–16 hours. A series of alkyl bromides are available for octyl, dodecyl and octadecyl respectively. Alkyl bromides have greater reactivity than the chlorides.

Scheme 5

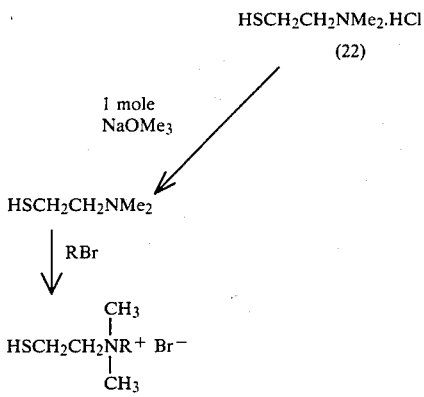

(1) R = $C_8H_{17}$
(2) R = $C_{12}H_{25}$
(3) R = $C_{18}H_{37}$

Method 6

An identical route was employed to that of method 5 for derivatives of 3-dimethylaminopropanethiol (39). As this material was prepared as the free amine and not hydrochloride salt, direct reaction with bromoalkane yielded quaternary salts (4)–(6). A major byproduct of this reaction was the alkene produced from elimination of HBr from the respective bromoalkane. These by-products were recovered in 20% yield.

Scheme 6

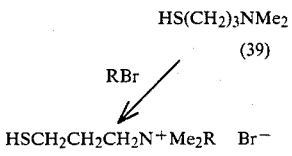

(4) R = $C_8H_{17}$
(5) R = $C_{12}H_{25}$
(6) R = $C_{18}H_{37}$

The compounds used in the invention have shown high corrosion inhibition at relatively low concentrations. Thus it is possible to obtain significant inhibition of corrosion using the active materials at levels as low as 1 ppm (by weight) of the fluid(s) in the systems requiring protection. The optimum corrosion inhibiting amount for the active materials of the invention will depend, among other things, upon the active material chosen, the metal(s) to be protected, the nature of the fluids having a corrosive tendency on these metals and the temperature and pressure within the system. However, by way of general indication, it may be said that the active material will generally be introduced into the system requiring protection at a concentration of from 1 to 10,000 ppm (by weight) of the fluid within the system, preferably at a concentration of 2 to 500 ppm, and for continuous injection applications most preferably at a concentration of 2 to 50 ppm. High concentrations (1000 to 10,000 ppm) may be desirable in batch treatments (such as is simulated in the film persistency test).

The active materials used in the invention will generally be handled in the form of a corrosion inhibiting composition comprising the active material and a suitable vehicle. The choice of vehicle will be affected by the particular application of the composition but will generally be selected from water and organic solvents such as hydrocarbons, alcohols, glycols and ethers, somewhat polar materials being preferred. Since the present compositions are generally water soluble (those with R groups of less than 18 carbon atoms) water solutions may be used, or, in the case of the less water soluble salts, dispersions may be employed. Isopropyl alcohol has also been found to be a general purpose carrier for the present compositions. However, if the corrosion system, i.e., the media is non aqueous, the present compositions may be dispersed in an organic carrier, although some of the long chain derivatives $C_{18}+$) exhibit solubility in both fresh water and hydrocarbons (see TABLE V). The active material will generally comprise from 1 to 70 wt. %. of the composition. The composition may also contain other conventional additives such as preservatives, flow improvers, antifreeze additives, biocides, fungicides, emulsion preventing agents, dispersing agents or additional corrosion inhibitors.

Twelve quaternary ammonium salts according to the present invention, were tested under four standard sets of corrosion wheel test conditions. These include a sweet-sour test in an all water system under a range of concentrations from 4–256 ppm (TABLE I). Tests 2 and 3 were run under sweet (TABLE III), and sour conditions (TABLE II) at low (4 ppm) and high (256 ppm) concentrations only. A film persistency test (TABLE IV) was also run for completeness of the screening sequence; however, it was not expected that these water soluble compounds would perform well under these test conditions. Results are presented in Tables I–IV. Due to the low solubility of some $C_{18}$ derivatives, 20% activity was adopted as a standard, with the $C_{18}$ compounds being submitted at 10% activity and added at double concentration to the test fluids. Table V shows solubility of 20% solutions (in IPA) in distilled water, 5% NaCl brine, kerosene and aromatic naphtha. Compounds are generally water and low brine soluble, hydrocarbon dispersible with some $C_{18}$ derivatives being soluble in both fresh water and hydrocarbon.

Due to the extremely high protection values obtained in the sweet test (Table III) a low inhibitor concentrations, some confirmatory tests were run under identical conditions. Table VI lists these results. Compounds (4)–(6) provide 63–74% protection. Thus the high results obtained in this sweet system are seen to be valid.

With the general result that performance is better with 3 methylene units between N and S than with 2 methylene units, the effect of addition of thiols to conventional quaternary amines was investigated, i.e., the possibility exists that the thiol residue and quaternary moeity are acting in a fashion which would be equally effective when available intermolecularly within a formulation. Table VII shows results obtained in a $CO_2$ only corrosive environment. Two optimum candidates from this work were included for comparison; (2) and (4). The quaternary derived from Coco amine provided reasonable protection at high concentration; however the $C_{10}$ derivative is too short an alkyl chain length to function effectively as a corrosion inhibitor. Addition of thiols to these quaternary amines, e.g., butane thiol, dodecane thiol and dimethylamino ethane thiol did not improve performance of either compound, neither did dodecene thiol alone give any corrosion protection. These results demonstrate that the quaternary and thiol functionalities need to be arranged intramolecularly as claimed in the present invention. Thus, it can be surmised the spatial arrangement of these two units (N and S) is a significant factor to inhibitor performance, since three methylenes have been observed to be superior to two between the N and S units.

It is believed that the site of action of the present corrosion inhibitors is within the surface deposits rather than on a clean metal surface where surfactant type molecules are arranged in a monolayer. The theories expressed here are presented here to aid in understanding how the invention may work, no theory is presented as a limitation on the invention as elsewhere described herein. The following examples are also not intended as limitations on the invention, but as illustrations of some aspects thereof.

EXAMPLES

The following are typical preparations for the respective types of thio compounds following schemes previously described.

COMPOUND 1 (VIA SCHEME 5)

25% sodium methoxide (0.1 mole) was added to a slurry of 2-dimethylaminoethanethiol hydrochloride (22) (0.1 mole) in isopropanol (100 ml). After 30 minutes the precipitated NaCl was filtered off and bromooctane (0.1 mole) was added with additional IPA sufficient to give a homogeneous solution. The mixture was refluxed for 4 hours, cooled, and solvent was evaporated to leave a yellow oil which solidified on standing. Solids were extracted with acetone, filtered off, and the filtrate was again evaporated to yield crystals whose spectroscopic data supported the structure (1). The same procedure was employed for preparation of compounds (2) and (3) using the corresponding 1-bromododecane and 1-bromooctadecane.

Compounds (4), (5) and (6) were prepared by the above procedure, except that 3-dimethylaminopropanethiol (39) was substituted for 2-dimethylaminoethanethiol (22), whose synthesis is described in Method 4 above.

COMPOUNDS 12 (VIA SCHEME 4)

25% sodium methoxide (0.1 mole) was added at room temperature to a solution of 3-dimethylaminopropanethiol (39) (0.1 mole) in isopropanol (50 ml) to generate the sulfide nucleophile. 1-Bromooctadecane (0.1 mole) was added and the mixture was refluxed for 5 hours then cooled to ambient temperature. Iodomethane (0.2 moles) was added dropwise over 30 minutes to produce a yellow paste. Solvents were evaporated and the quaternary salt (12) was purified by precipitation from mixed solvents.

Compounds 10 and 11 were also prepared according to scheme 4 with the appropriate starting materials.

In the following tables, the structures are represented as follows:

8.2.SH represents:

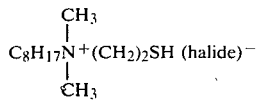

and 18.3.$R_2S$ represents:

$C_{18}H_{37}S(CH_2)_3N^+Me_2$ (halide)$^-$

The designate "No." in ( ) in each TABLE corresponds to the salt designated in Schemes 1–6 above.

TABLE I

| Corrosion Wheel Test Results | | | | | |
|---|---|---|---|---|---|
| | | % Protection @ (ppm) | | | |
| No. | Structure | 4 | 8 | 16 | 256 |
| (1) | 8.2.SH | 33 | 40 | 41 | 73 |
| (2) | 12.2.SH | 35 | 44 | 67 | 77 |
| (3) | 18.2.SH | 31 | 41 | 58 | 60 |
| (4) | 8.3.SH | 32 | 55 | 66 | 76 |
| (5) | 12.3.SH | 30 | 59 | 67 | 76 |
| (6) | 18.3.SH | 11 | 26 | 59 | 75 |
| (7) | 8.2.$R_2S$ | 15 | 17 | 11 | 31 |
| (8) | 12.2.$R_2S$ | 7 | 13 | 23 | 81 |
| (9) | 18.2.$R_2S$ | 26 | 33 | 52 | 66 |
| (10) | 8.3.$R_2S$ | 18 | 23 | 24 | 50 |
| (11) | 12.3.$R_2S$ | 21 | 27 | 35 | 79 |
| (12) | 18.3.$R_2S$ | 49 | 56 | 57 | 69 |

Blank weight loss: 40 ± 0.9 mg

Test Conditions:

| | |
|---|---|
| Temperature: | 160° F. |
| Duration: | 24 hours |
| Fluids: | 3% NaCl brine only |
| Corrosives: | Saturated $CO_2$ + 100 ppm $H_2S$ |
| Replicates: | Duplicates w/ triplicate blanks |
| Inhibitor Activity: | 20% |

TABLE II

| Corrosion Wheel Test Results | | | |
|---|---|---|---|
| | | % Protection @ (ppm) | |
| No. | Structure | 4 | 256 |
| (1) | 8.2.SH | 30 | 84 |
| (2) | 12.2.SH | 23 | 79 |
| (3) | 18.2.SH | 11 | 83 |
| (4) | 8.3.SH | 3 | 81 |
| (5) | 12.3.SH | 17 | 77 |
| (6) | 18.3.SH | 14 | 71 |
| (7) | 8.2.$R_2S$ | 7 | 72 |
| (8) | 12.2.$R_2S$ | 3 | 78 |
| (9) | 18.2.$R_2S$ | 6 | 75 |
| (10) | 8.3.$R_2S$ | 12 | 75 |
| (11) | 12.3.$R_2S$ | 15 | 80 |
| (12) | 18.3.$R_2S$ | 14 | 81 |

Blank weight loss: 55.8 ± 1.0 mg

Test Conditions:

| | |
|---|---|
| Temperature: | 160° F. |
| Duration: | 24 hours |
| Fluids: | 3% NaCl brine only |
| Corrosives: | Saturated $N_2$ + 500 ppm $H_2S$ |
| Replicates: | Duplicates and triplicate blanks |
| Inhibitor Activity: | 20% |

TABLE III

| Corrosion Wheel Test Results | | | |
|---|---|---|---|
| | | % Protection @ (ppm) | |
| No. | Structure | 4 | 256 |
| (1) | 8.2.SH | 50 | 87 |
| (2) | 12.2.SH | 56 | 81 |
| (3) | 18.2.SH | 62 | 92 |
| (4) | 8.3.SH | 83 | 86 |
| (5) | 12.3.SH | 82 | 85 |
| (6) | 18.3.SH | 83 | — |
| (7) | 8.2.$R_2S$ | 29 | 65 |

TABLE III-continued

| Corrosion Wheel Test Results | | | |
|---|---|---|---|
| | | % Protection @ (ppm) | |
| No. | Structure | 4 | 256 |
| (8) | 12.2.$R_2$S | 14 | 76 |
| (9) | 18.2.$R_2$S | 38 | 84 |
| (10) | 8.3.$R_2$S | 81 | — |
| (11) | 12.3.$R_2$S | 60 | 84 |
| (12) | 18.3.$R_2$S | 50 | 83 |

Blank weight loss: 29.0 ± 0.8 mg

Test Conditions:

Temperature: 160° F.
Duration: 24 hours
Fluids: 50-50 3% NaCl brine - Mentor
Corrosives: Saturated $CO_2$ only
Replicates: Duplicates w/ triplicate blanks
Inhibitor Activity: 20%

TABLE IV

| Film Persistent Corrosion Wheel Test Results | | |
|---|---|---|
| No. | Structure | % Protection @ 10,000 ppm |
| (1) | 8.2.SH | 56 |
| (2) | 12.2.SH | 64 |
| (3) | 18.2.SH | 53 |
| (4) | 8.3.SH | 14 |
| (5) | 12.3.SH | 25 |
| (6) | 10.3.SH | 71 |
| (7) | 8.2.$R_2$S | 11 |
| (8) | 12.2.$R_2$S | 19 |
| (9) | 18.2.$R_2$S | 17 |
| (10) | 8.3.$R_2$S | 8 |
| (11) | 12.3.$R_2$S | 20 |
| (12) | 18.3.$R_2$S | 14 |

Blank weight loss: 58.3 ± 3.3 mg

Test Conditions:

Temperature: 160° F.
Duration: Film 1 hr, Rinse 1 hr, Run 24 hrs.
Fluids: 50-50 3% NaCl brine - Mentor
Corrosives: Saturated $CO_2$ + 100 ppm $H_2S$
Replicates: Single data points with triplicate blanks

TABLE V

| Inhibitor Solubility Test | | | | | |
|---|---|---|---|---|---|
| | | | Solubility In: 5% NaCl | | |
| No. | Structure | Distilled Water | Brine | Kerosene | Aromatic Naphtha |
| (1) | 8.2.SH | sol | disp | disp | disp |
| (2) | 12.2.SH | sol | disp | disp | disp |
| (3) | 18.2.SH | sol | disp | sol | sol |
| (4) | 8.3.SH | sol | disp | disp | disp |
| (5) | 12.3.SH | sol | sol | disp | disp |
| (6) | 18.3.SH | sol | insol | disp | disp |
| (7) | 8.2.$R_2$S | sol | sol | disp | disp |
| (8) | 12.2.$R_2$S | sol | sol | disp | disp |
| (9) | 18.2.$R_2$S | disp | insol | disp | disp |
| (10) | 8.3.$R_2$S | sol | sol | disp | disp |
| (11) | 12.3.$R_2$S | sol | sol | disp | disp |
| (12) | 18.3.$R_2$S | sol | insol | disp | sol |

Test Conditions:
20% Active Inhibitor was added at 0.5% by volume to test fluid. Observed initially and after 24 hours.
Abbreviations are as follows:
sol = soluble
disp = dispersible
insol = insoluble

TABLE VI

| Corrosion Wheel Test Results | | | | | | |
|---|---|---|---|---|---|---|
| | | % Protection @ (ppm) | | | | |
| No. | Structure | 2 | 4 | 8 | 32 | 128 |
| (1) | 8.2.SH | 40 | 25 | 44 | 77 | 83 |
| (2) | 12.2.SH | 13 | 42 | 69 | 82 | 80 |
| (3) | 18.2.SH | 18 | 18 | 76 | 79 | 81 |

TABLE VI-continued

| Corrosion Wheel Test Results | | | | | | |
|---|---|---|---|---|---|---|
| | | % Protection @ (ppm) | | | | |
| No. | Structure | 2 | 4 | 8 | 32 | 128 |
| (4) | 8.3.SH | 41 | 63 | 82 | 80 | 78 |
| (5) | 12.3.SH | 45 | 63 | 79 | 80 | 78 |
| (6) | 18.3.SH | 30 | 74 | 75 | 80 | 85 |
| (8) | 12.2.$R_2$S | 9 | 19 | 18 | 62 | 82 |
| (10) | 8.3.$R_2$S | 10 | 12 | 20 | 25 | 51 |

Blank weight loss: 23.2 ± 1.2 mg

Test Conditions:

Temperature: 160° F.
Duration: 24 hours
Fluids: 50-50 3% NaCl brine - Mentor
Corrosives: Saturated $CO_2$ only
Replicates: Duplicates w/ triplicate blanks

TABLE VII

| Corrosion Wheel Test Results | | | | |
|---|---|---|---|---|
| | | % Protection @ (ppm) | | |
| No. | Structure | 2 | 8 | 128 |
| (2) | 12.2.SH | 23 | 72 | 84 |
| (4) | 8.3.SH | 62 | 86 | 85 |
| | $C_{10}H_{21}NMe_3I$ + $Me_2N(CH_2)_2SH$ | 13 | 16 | 33 |
| | Coco $NMe_3I$ + $Me_2N(CH_2)_2SH$ | 22 | 34 | 85 |
| | $C_{10}H_{21}NMe_3I$ + $C_4H_9SH$ | 0 | 8 | 4 |
| | Coco $NMe_3I$ + $C_4H_9SH$ | 12 | 28 | 85 |
| | Coco $NMe_3I$ + $C_8H_{17}SH$ | 10 | 20 | 79 |
| | $C_{12}H_{25}SH$ | 4 | 7 | 0 |
| | $C_{10}H_{21}NMe_3I$ | 0 | 4 | 3 |
| | Coco $NMe_3I$ | 5 | 20 | 83 |

Blank weight loss: 25.0 ± 1.0 mg

Test conditions:

Temperature: 160° F.
Duration: 24 hours
Fluids: 50-50 - 3% NaCl brine - Mentor
Corrosives: Saturated $CO_2$ only
Replicates: Duplicates w/ triplicate blanks

The invention claimed is:

1. A method of inhibiting corrosion of metals, which comprises treating a system wherein metals are susceptible to corrosion with a corrosion inhibiting amount of a thio substituted quaternary ammonium salt having the structure:

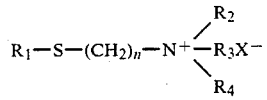

wherein $R_1$ is hydrogen or a hydrocarbyl group having 6 to 30 carbon atoms; n is 0 to 18;

$R_2$, $R_3$ and $R_4$ are independently selected from hydrogen, alkyl or aralkyl groups having 1 to 30 carbon atoms and X is an anion.

2. The method as defined in claim 1 wherein n is 2 to 6.

3. The method according to claim 1 wherein $R_1$ is a hydrogen, n is 2 or 3, $R_2$, $R_3$ and $R_4$ are alkyl and X is a halide.

4. The method according to claim 3 wherein n is 2, $R_2$ and $R_3$ are methyl, $R_4$ is an alkyl radical having 8 to 18 carbon atoms and X is Br.

5. The method according to claim 4 wherein $R_4$ is octyl.

6. The method according to claim 4 wherein $R_4$ is dodecyl.

7. The method according to claim 4 wherein $R_4$ is octadecyl.

8. The method according to claim 3 wherein n is 3, $R_2$ and $R_3$ are methyl, $R_4$ is an alkyl radical having 8 to 18 carbon atoms and X is Br.

9. The method according to claim 8 wherein $R_4$ is octyl.

10. The method according to claim 8 wherein R is dodecyl.

11. The method according to claim 8 wherein $R_4$ is octadecyl.

12. The method according to claim 1 wherein $R_1$ is an alkyl radical having 8 to 18 carbon atoms, n is 2 or 3, $R_2$, $R_3$ and $R_4$ are alkyl and X is a halide.

13. The method according to claim 12 wherein n is 2, $R_2$, $R_3$ and $R_4$ are methyl and X is I.

14. The method according to claim 13 wherein $R_1$ is octyl.

15. The method according to claim 13 wherein $R_1$ is dodecyl.

16. The method according to claim 13 wherein $R_1$ is an octadecyl.

17. The method according to claim 12 wherein n is 3, $R_2$, $R_3$ and $R_4$ are methyl and X is I.

18. The method according to claim 17 where $R_1$ is octyl.

19. The method according to claim 17 wherein $R_1$ is dodecyl.

20. The method according to claim 17 wherein $R_1$ is octadecyl.

* * * * *